United States Patent [19]

Mäkipirtti et al.

[11] Patent Number: 4,561,884

[45] Date of Patent: Dec. 31, 1985

[54] APPARATUS FOR REMOVAL OF IMPURITY COMPONENTS FROM SULPHIDIC AND METALLIZED MOLTEN COPPER MATTES

[75] Inventors: Simo A. I. Mäkipirtti; Pekka T. Setälä, both of Nakkila, Finland

[73] Assignee: Outokumpu Oy, Helsinki, Finland

[21] Appl. No.: 305,509

[22] Filed: Sep. 25, 1981

[30] Foreign Application Priority Data

Sep. 26, 1980 [FI] Finland ..... 803053

[51] Int. Cl.[4] ..... C22B 1/02

[52] U.S. Cl. ..... 75/21; 75/6; 75/7; 75/23

[58] Field of Search ..... 75/6, 7, 21, 23

[56] References Cited

U.S. PATENT DOCUMENTS 3,450,523 6/1969 Socolescu ..... 75/21

3,933,475 1/1976 Swanson ..... 75/21

*Primary Examiner*—P. D. Rosenberg

*Attorney, Agent, or Firm*—Brooks Haidt Haffner & Delahunty

[57] ABSTRACT

A process for the removal of impurities from sulphidic and metallized molten copper mattes, in which in preliminary smelting of the crude metal molten sulphide and molten arsenide-antimonide phases are produced, whereby (a) the molten arsenide-antimonide matte is treated with elemental sulphur vapor to produce molten sulphide and molten arsenide phases in equilibrium with each other, that after this the conjugate melt system is sulphurated continuously under reduced pressure in order to volatilize arsenic, antimony, bismuth, lead and tin, or (b) the conjugate molten phases in equilibrium with each other are separated from each other, the thus separated arsenide matte is sulphurated further in a solid state and advantageously using elemental sulphur vapor at high partial pressure in order to volatilize arsenic, antimony, bismuth, selenium and tellurium from the matte as sulphides, and the separated molten sulphide phase is sulphurated under reduced pressure to volatilize arsenic, antimony, bismuth, lead and tin from the melt.

4 Claims, 5 Drawing Figures

APPARATUS FOR REMOVAL OF IMPURITY COMPONENTS FROM SULPHIDIC AND METALLIZED MOLTEN COPPER MATTES

BACKGROUND OF THE INVENTION

The process of the present invention relates to the removal of impurity components from sulphidic and metallized molten copper mattes obtained in the pyrometallurgical processing of sulphidic complex and mixed copper ores, which said mattes often contain very large amounts of impurities. The very great difficulties associated with these impurity metals Pb, Zn, Ni, Co, As, Sb, Bi, Se, Te etc., in pyrometallurgical methods of copper refining are generally known. These impurities do not pass into the slag or volatilize to a sufficient extent in the processing of ores to crude metal. In pyrometallurigcal processes compounds of these metals or metalloids, which dissociate easily to the metal, follow the principal metal throughout the processing. At every stage of the processing an effort is made to remove these impurity compounds because if they remain in the crude metal they render it more difficult to refine and their presence even in very low concentrations in the final product is detrimental.

In the production of copper by means of customary methods (matte smelting, conversion) removal of part of the arsenic, antimony, bismuth, lead etc. present in concentrates and ores is achieved, but nevertheless not to a sufficient extent. In connection with the production of sulphide mattes it is possible to influence the elimination of the impurities being considered by choice of a suitable smelting technique. When using shaft, reverberatory and electric furnaces about half the mentioned impurities remain in the sulphide phase. Results considerably better than this, particularly in respect of arsenic and bismuth, are obtained in suspension smelting processes especially when smelting sulphide mattes rich in value metals.

Irrespective of the method of smelting used and even for ores or concentrates having relatively low contents of Pb(Co,Ni) and As(Sb,Sn) it may happen that the resulting melt divides into two layers. This is because of the formation of an arsenide-antimonide melt in addition to the sulphide melt. This arsenide-antimonide melt is metallurigically an extremely undesirable intermediate product containing so-called speiss forming metals, i.e. Co, Ni, Fe, As, Sb, Au, Ag, Te, Cu, Sn, Pb, Se. If the melt contains a considerable amount of lead then a crude lead phase will also be formed in addition to sulphide and arsenide phases.

Known processes comparable in their technical standard to novel inventions include fairly numerous subprocesses and combinations of processes relating to the treatment of arsenide-antimonide mattes.

The recovery of the components of arsenide-antimonide mattes only started early in this century. A view of the standard and changes in process technology during this century can be gained from the following publications among others: C. Guillemain: Metallurgie, VII, 1910, 595–602; H. Kleinheisterkamp: Erzmetall, I, 1948, 247–253; L. Fontainas, M. Coussement, R. Maes: Trans Instn Min Met, 88, 1979, 13–23.

The arsenide-antimonide matte separated in preliminary smelting or conversion is usually metallized, i.e. it generally contains large amounts of copper and lead in so-called physical solution and is lean in respect of actual speiss-forming metals. The first stage in refining the matte is its enrichment in respect of arsenic, antimony, nickel and cobalt.

Lead concentrate can be used for enrichment of the matte, particularly if the matte has a high lead content to start with. If this is done, part of the iron and copper present in the arsenide matte pass into the sulphide phase. Lead separates out into a phase of its own, in which antimony freed by decomposition of antimonides dissolves $$Fe(2Cu)+PbS \longleftrightarrow FeS(Cu_2S)+Pb$$

$$2Cu_3Sb+3PbS \longleftrightarrow 3Ci_2S+3Pb+2Sb$$

The direct use of elemental sulphur in the enrichment of arsenide matte has been proposed, Blanderer: Erzmetall, XVII, 1964, 247–253. After enrichment the melt can be further sulphidated with elemental sulphur, thereby displacing arsenic from the arsenides. This is not generally done in practice, however, because as a consequence of the low partial pressure of arsenic large excesses of sulphur are required.

The successful processing of arsenide-antimonide matte is associated with the problem of separating the arsenic and antimony as completely as possible from the other components of the matte. For these other components (Co, Ni, Cu, Pb, Sn, Ag, Au) excellent hydrometallurgical separation processes have been developed. Some methods which have been developed for the separation of arsenic and antimony from similar mattes will be examined. The good volatility of arsenic and its compounds has long been known.

The distillation of arsenic, exploiting the dissociation of arsenides, does not yield quantitative results. The volatilization of arsenic for example from nickel and cobalt attains a value of 10% only at temperatures above 1000° C.

The decomposition and sulphide volatilization of arsenides using elemental sulphur has already been dealt with. The decomposition of solid arsenides and the sulphidic volatilization of arsenic has been successfully tried also using iron pyrites as the source of sulphur, H. W. Loose: Chemismus der Entfernung von Arsen aus seinen Verbindungen mit Eisen, Kupfer, Nickel und Kobalt durch Erhitzen in Anwesenheit von Pyrit, Berlin 1931, 1–63. The addition of iron sulphide, however, reduces the concentration of sulphides of value metals in the product to such an extent that the process is not considered economic. The arsenic volatilization process according to U.S. Pat. No. 1,718,825 is also based on the use of sulphur, the arsenides being mixed with substances containing sulphur and with coal in sufficient quantity to form a self-roasting mixture. While roasting the mixture in this process a low-oxygen COS atmosphere is maintained.

Chlorination of the arsenic in arsenide mattes is effective, but technical problems have prevented the use of such processes. When the matte is chlorinated at a temperature below 600° C. both arsenic and iron volatilize as chlorides, U.S. Pat. No. 1,406,595. When arsenide matte is roasted at a temperature of approx. 800° C. in the presence of hydrochloric acid the arsenic is volatilized completely.

Customary methods of treating arsenides include the oxidizing calcination of arsenic (and antimony). The methods do not, however, lead to the quantitative elimination of arsenic. At temperatures over 300° C. the volatile arsenic trioxide formed in the oxidation has a tendency to disproportion and the nascent pentoxide unites with metal oxides to form arsenates. Written for cobalt the reaction is

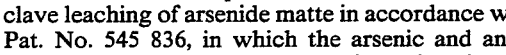

$$2Co_5As_2+9O_2 \longleftrightarrow 5CoO.As_2O_5+5CoO+As_2O_3$$

Many methods have been proposed to prevent the formation of arsenates. A good method is calcination in the presence of sulphur dioxide, as a result of which arsenates decompose and arsenic pentoxide is reduced. In respect of cobalt even this method of calcination is inadequate, because at a temperature of 1100° C. the volatilization of arsenic only corresponds to a value of 70%. Because complete oxidative volatilization is not feasible, it is often desired that the arsenic content of the product is high enough to permit precipitation of iron arsenate in hydrometallurgical refining.

Mention may also be made of the industrially used method of soda calcination of arsenide matte based on U.S. Pat. No. 1,505,718 and DE Pat. No. 1 129 707, in which arsenic is converted to water-soluble sodium arsenate. Another important method is the direct autoclave leaching of arsenide matte in accordance with DE Pat. No. 545 836, in which the arsenic and antimony acids obtained as a product are hydrolyzed to oxides with the value metals remaining in solution as sulphates.

It is an object of the present invention to provide a combination of methods which is more advantageous than previous methods in the processing of molten phases, principally of copper, containing harmful impurities.

SUMMARY OF THE INVENTION

In accordance with the present invention a process is provided for the removal of impurity components from sulphidic and metallized molten copper mattes, in which (a) the molten arsenide-antimonide matte is treated with elemental sulphur vapour to produce molten sulphide and molten arsenide phases in equilibrium with each other, that after this the conjugate melt system is sulphurated continuously under reduced pressure in order to volatilize arsenic, antimony, bismuth, lead and tin, or (b) that the conjugate molten phases in equilibrium with each other are separated from each other, the thus separated arsenide matte is sulphurated further in a solid state and advantageously using elemental sulphur vapour at high partial pressure in order to volatilize arsenic, antimony, bismuth, selenium and tellurium from the matte as sulphides, and the separated molten sulphide phase is sulphurated under reduced pressure to volatilize arsenic, antimony, bismuth, lead and tin from the melt.

The process according to the invention relates primarily to the treatment of molten arsenic, antimony and bismuth mattes containing Cu, Ni, Co, Fe, Pb, Sn for the recovery of value metals from them and for the separation of arsenic, antimony and bismuth from the principal metals. The first stage in the process is the sulphidation of the molten arsenic-antimony matte (Co—Ni—Cu—Pb—Sn—Fe—As—Sb—Bi—S). The original melt then separates into two conjugate melts which are in equilibrium with each other and one of which is enriched in respect of arsenic and antimony (Co—Ni—Cu—As—Sb—Bi) and the other with respect to sulphur (Cu, Pb, Sn, Fe, S).

The second stage of the process is the separation of arsenic, antimony and bismuth from the conjugate melts. This is done in either of two ways depending on the composition of the melts:

If the amounts of nickel and cobalt in the melt system are large, an arsenic-antimony melt rich in cobalt and nickel is separated from the sulphide melt. The arsenide-antimonide matte thus obtained is chrushed, pulverized and sulphidated in the solid state using sulphur vapour with arsenic and antimony vapourizing at the same time. The treatment is based on the method according to Finnish Pat. No. 56 196. The sulphide melt, which has become enriched inter alia with respect to lead and tin and which contains arsenic and antimony in amounts corresponding to the conjugate equilibrium, is treated in a vacuum. The impurity components mentioned then volatilize and a refined copper-iron sulphide matte is obtained as the product.

If the amounts of nickel and cobalt in the melt system are low (or when it is not desired to perform separation of the nickel and cobalt) then the conjugate melt system is treated continuously in a vacuum so that the components considered to be impurities (Pb, Sn, As, Sb, Bi) volatilize and a partially refined sulphide matte (Cu—Ni—Co—Fe—S) is obtained as the product.

The amount of harmful impurities in the sulphide matte which is obtained in equilibrium with the arsenide-antimonide matte from the preliminary smelting, conversion or preliminary sulphidation stages is low as a result of the favourable equilibrium conditions. The lead and tin contents of the sulphide matte obtained from the sulphidation enrichment of arsenide matte may nevertheless rise to quite considerable levels.

For copper (and also nickel) sulphide melts a fall in the activities of the main metals is accompanied by a rise in the activities of the impurity components and similarly in their vapour pressures when moving away from the solubility gap to the region of homogeneous melts. An increase in the activities (Of impurities) is accordingly achieved by raising the sulphur potential of the melt or also by refining sulphide matte which is lean and thus already intrinsically high as regards its sulphur potential, H. Kametani, C. Yamauchi: Trans. of Mat. Res. Inst. for Metals, 2D, 1978, 22–59; A.P.C. Hallowes: British Non-Ferrous Metals Research Association, Rep. R.R.A. 543, 1940, 1–17; R. W. Ruddle: The Physical Chemistry of Copper Smelting, London 1956, 122–131; A. Yazawa, H. Azakami: Can. Met. Quart. 8, (1969), 257–261; 13, (1974), 443–453.

DESCRIPTION OF THE DRAWINGS

In order to clarify the consideration of the process according to the invention equilibrium diagrams (FIGS. 1 and 2) have been prepared for two arsenic matte systems that come within the scope of the invention. In the Cu—As—S system of FIG. 1 the Cu—S binary solubility gap extents at a temperature of 1200° C. to a content of approx. 23 wt. % As. The critical point of the gap corresponds to the composition (wt. %) 72.4 Cu, 19.5 As and 8.1 S. It can be seen from the diagram that for a low-sulphur metal melt there is no substantial change in the sulphur content as the arsenic content increases within the range 0–21% As. The compositions of high-sulphur melts corresponding to the solubility gap are located for As-contents up to 14% on the line 80Cu+20S/66Cu+34As.

Figure 1:
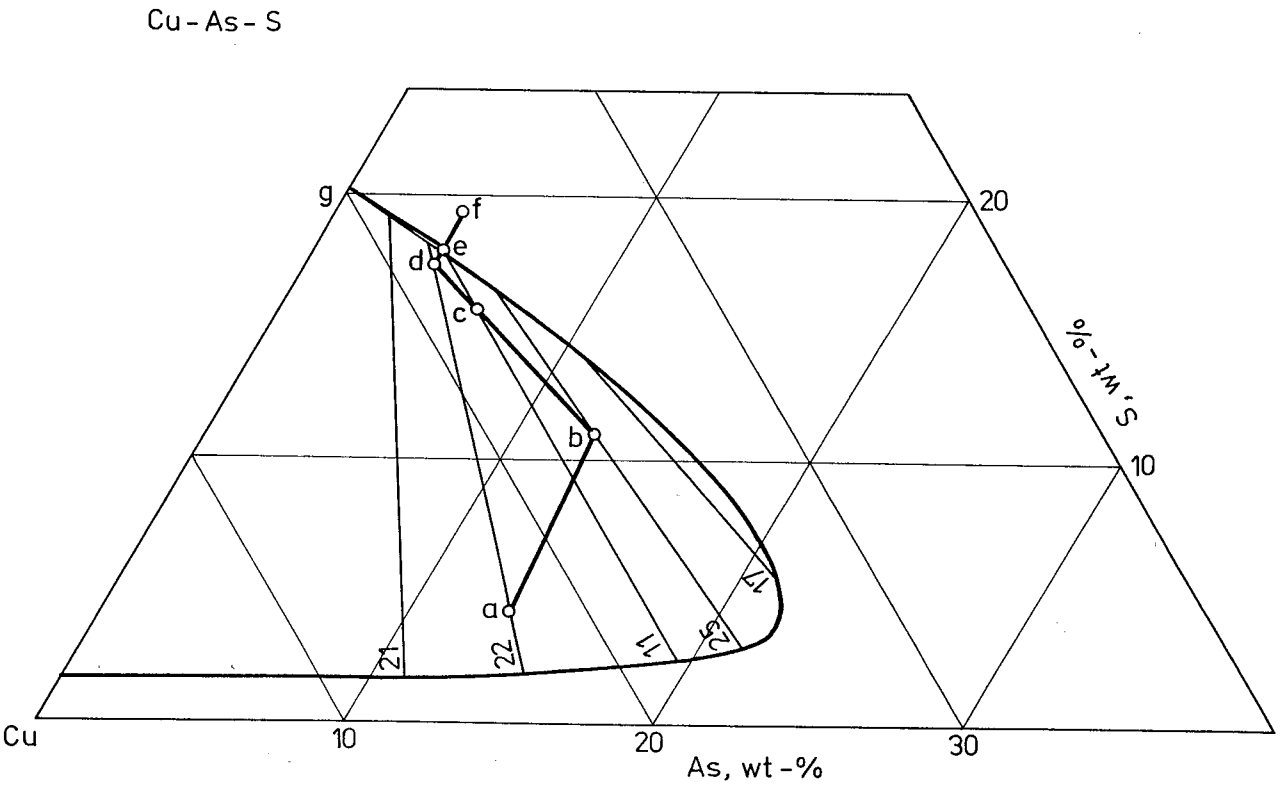

Arsenide-antimonide matte similar to the multi-component system considered above is obtained as a common and undesirable intermediate product in the smelting of complex ores. The initial composition of the arsenide matte considered here corresponds to composition no. 0 in table 1.

DESCRIPTION OF THE PREFERRED EMBODIMENTS

In the first phase of the process according to the invention the arsenide matte (no. 0) is sulphidated. The purpose of the sulphidation is to divide the original melt into two conjugate melts, the aim being that as much as possible of the copper, lead and tin shall pass into the sulphide melt. The arsenide-antimonide melt is then correspondingly enriched in respect of nickel, cobalt, gold and the platinum metals. On the basis of experiments and observations that have been made, using elemental sulphur the sulphidation can be carried out so that volatilization losses do not occur in respect of arsenic and antimony. This was the case, for example, in the sulphidation of the original matte to correspond to equilibrium no. 5 (table 1). The distribution values then obtained for arsenic, antimony, nickel and cobalt are 46.7, 16.3, 33.8 and 8.6 respectively. Analyses of the equilibrium melts are given in table 1. Similar sulphidation results have also been achieved using pyrities and solid elemental sulphur, H. Kleinheisterkamp: Ueber die Grundlagen der Speisebildung im Schachtofen, 30.5.1944, Berlin, 87, Tab. 9.

In the system Cu—As—S the same phenomena are naturally also observable when carrying out sulphidation. Because of the unfavourable conode equilibria, however, arsenic occurs in high concentrations also in the sulphide matte.

The low volatilization values for arsenic and antimony in sulphidation are a result of the low activities of these elements in the molten mixture. The activity coefficient (at infinite dilution) for elements in a molten binary mixture with copper falls as a function of the group number in a period of the periodic system, A. Yazawa, K. Itakagi, T. Azakami: Trans JIM, 16, 1975, 687–95. Thus in the fourth period, groups Ib–VIb, the activity coefficient log $\gamma_{Me}^{\circ}$ falls almost linearly from 0 to −3 respectively, except that arsenic (no. 33) exhibits a negative deviation (log $\gamma_{As}^{\circ}=-3.5$). In the fifth period the slope of the coefficient log $\gamma^{\circ}$ is almost the same as in the fourth, but with antimony now constituting an exception (log $\gamma_{Sb}^{\circ}=-2.2$). In the sixth row the slope of the relation between the coefficient log $\gamma^{\circ}$ and the atomic number becomes positive, so that for example the $\gamma^{\circ}$ values of lead (82) and bismuth (83) are 7.9 and 3.2 respectively.

In binary Cu—As the relation log $\gamma_{As}=-15.39\,N_{Cu}^2+3.78$ has been obtained for the activity coefficient of arsenic in the concentration range $N_{As}=0.22$–0.27 at a temperature of 1100° C., D. G. Jones, D. H. Philipp: Instn. Min. Met., 1979, C7–C10. For the compositions $N_{As}=0.22$, 0.25 ($Cu_3As$) and 0.29 (extrapolated, $Cu_5As_2$) the activity coefficient of arsenic is respectively $\gamma=2.5\times10^{-6}$, $1.1\times10^{-5}$ and $1.1\times10^{-4}$. In melts the activity of arsenic, and thus also its vapour pressure, begins to increase only at high concentrations of arsenic.

For low concentrations in binary mixtures with copper, J. Bode: Messung der Aktivitäten von Arsen, Antimon, Wismut und Blei in flüssigem Kupfer, Berlin 1969, 1–45, the following values are obtained for the activity coefficients (T°C./$\gamma$/Me, weight %): $1300/3.5\times10^{-3}/2.43$ Sb; $1300/3.9\times10^{-3}/3.1$ Sb; 1300/1.02/3.0 As; 1100/8.5/1.75 Pb; 1200/5.6/1.75 Pb; 1100/1.7/1.79 Bi; 1200/1.4/1.79 Bi.

Figure 2:
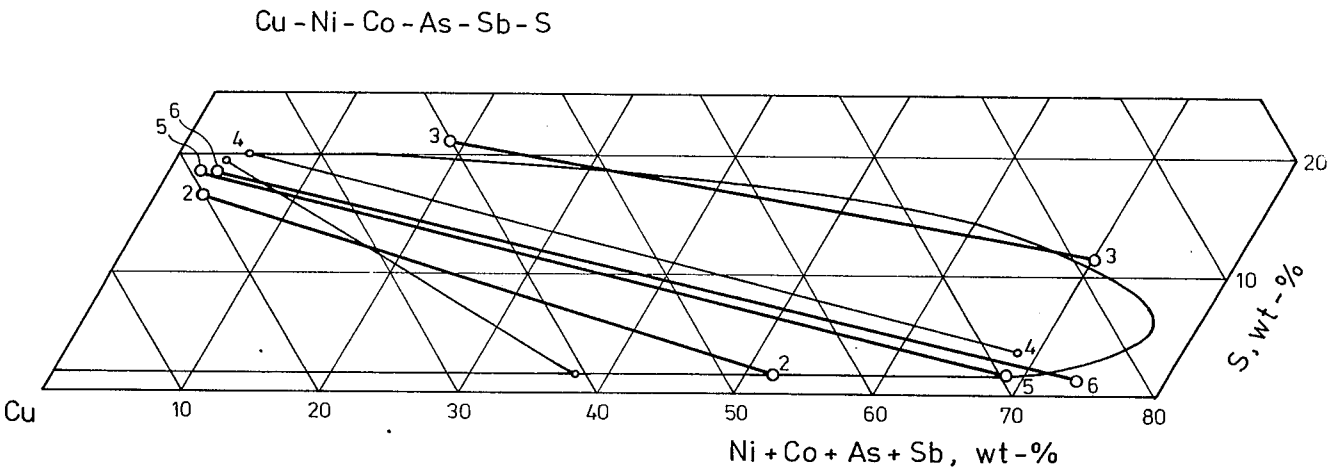
In FIG. 2 the corresponding equilibrium diagram for the system Cu—Ni—Co—Fe—Pb—Sn—As—Sb—Bi—S is shown, the sum Ni+Co+As+Sb+Bi being taken as a concentration axis in addition to sulphur. The concentrations of metals in the molten phases and the Nernst distributions of the metals (L=Me %, arsenide phase/Me sulphide phase) for the conode equilibria of the diagram are given in table 1. According to FIG. 2 the depth of the solubility gap in respect of arsenic has increased to approx. 40% As owing to the effect of the nickel and cobalt etc. In the system Cu—As—S the distribution value of arsenic is max. L=6. From table 1 it can be seen that in the presence of nickel and cobolt the components have high distribution values, viz. $L_{As}=47$, $L_{Ni}=34$, $L_{Co}=9$. Owing to the high distribution values the corresponding metal concentrations in the sulphide matte are quite low.

Sulphidation causes a displacement of the molten region of arsenide-antimonide matte towards higher temperatures, which is advantageous for further processing of the matte in the solid state. According to DTA measurements the temperature ranges for endothermic transitions of arsenide-antimonide mattes corresponding to the equilibria shown in FIG. 2 are as follows:

| | | | | | |
|---|---|---|---|---|---|
| No. 0 | — | — | 687–720° | — | 400° C. |
| No. 5 | 860° | — | 690° | 552° | |
| No. 6 | 877–890° | — | 670° | 548° | |
| No. 3 | 895–960° | 783° | — | — | |

The arsenide-antimonide matte is sulphidated in the solid state using elemental sulphur vapour with a high partial pressure by means of the structural transformation sulphidation process which is known per se, FI Pat. Nos. 56 196 and 57 090 and FI patent application No. 782 034. Under the effect of the structural transformation sulphidation the metals bound in the matte are sulphidated to stable sulphides and the arsenic, antimony, bismuth, selenium and tellurium volatilize as sulphides under their own vapour pressure. The structural transformation sulphidation can be described, for example, by the reaction equations:

$$4(Ni,Co)As(s)+[5+2x]S_2(g)\longleftrightarrow 4(Ni,Co)S_{1+x}(s)+As_4S_6(g)$$

$$2(Ni,Co)_5As_2(s)+[8+5x]S_2(g)\longleftrightarrow 10(Ni,Co)S_{1+x}(s)+As_4S_6(g)$$

$$4(1-1/2x)Cu_3As(s)+[6-11/2x]S_2(g)\longleftrightarrow 6Cu_{2-x}S(s)+[1-1/2x]As_4S_6(g)$$

$$4Cu_3As(s)+12FeS(s)+9S_2(g)\longleftrightarrow 12CuFeS_2(s)+As_4S_6(g)$$

The heat balance of the sulphidation process can be adjusted, and the process thereby controlled, by making use of the dissociation-recombination energy of the sulphur vapour. The amount and speed of volatilization of arsenic, antimony and bismuth can be increased by continuously converting the sulphide phase which has volatilized into the oven space into halides. The sulphide matte which is obtained in equilibrium with the arsenide-antimonide matte as a result of sulphidation only contains small amounts of the components of the arsenide-antimonide matte (which can be considered as impurities in the sulphide matte) because of the activity conditions. The proportions of the metals (weight % Me) which pass into the sulphide matte can be presented approximately as the following Leutwein series: 100 Pb, 98 Zn, 93 Hg, 92 Se, 92 Tl, 86 In, 81 Te, 80 Cu, 79 Fe, 78 Sn, 52 Bi, 27 Au, 23 Sb, 20 Co, 11 Ni, 6 Pd, 1.1 Pt and 0.3 Ir.

Results in broad agreement with the above series can be seen in the concentration and distribution values given in table 1 (for example no. 5: Pb, Cu, Fe, Sn, Bi, Co, Sb, Ni).

Figure 3:
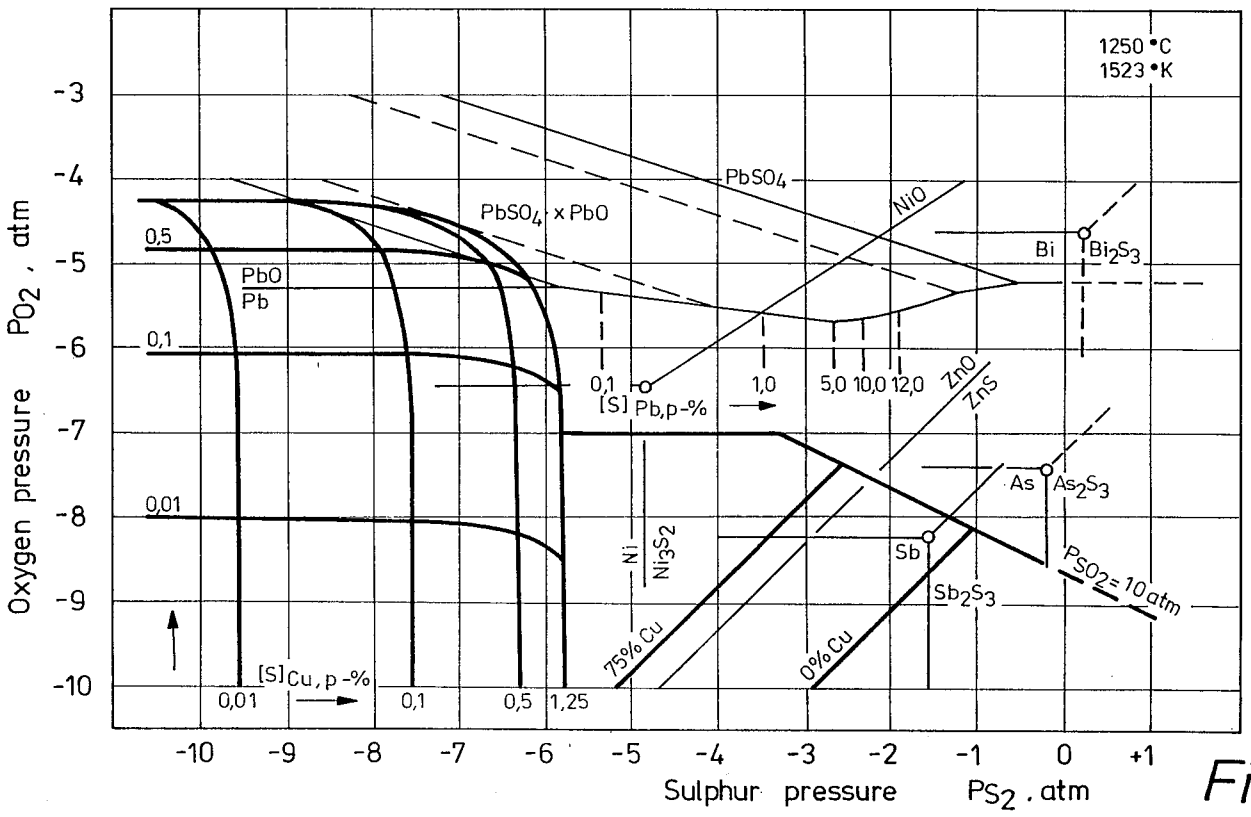

The calculated stability regions of the phases occurring in the systems Cu—Fe, Pb, Zn, Ni, As, Sb, Bi—S—O are shown in FIG. 3 as a function of the sulphur and oxygen pressures of the gas phase. The tendency of both lead and also arsenic, antimony and bismuth to occur in metallic form up to quite moderate sulphur pressures will be seen from the figure.

As has already been stated, with the exception of bismuth, lead and zinc, the activities of many impurity elements are very low in binary (and also poly-metallic) mixtures with copper. Moving away from the solubility gap ($a_{Cu} \approx 1$) a fall in the copper activity of the mixture is accompanied by a rapid rise in the activities of many of the impurity metals. Among factors affecting the change in activity is the quantitative increase of sulphur in the mixture and the increase in the sulphur pressure of the system which usually follows this. The increase in the sulphur pressure of the system Cu—Fe—S—O as the iron content of the sulphide melt increases (75% and 0% Cu) has been drawn in FIG. 3. The high activity values of impurity components in either lean sulphide mattes or sulphur-saturated melts (Cu—Fe—S, Cu—S, Ni—S) have been exploited in many volatilization methods for arsenic, antimony and bismuth based on the use of a vacuum or gas-vacuum or on halogenation.

If the nickel and cobalt contents of the melt system are low then the conjugate melts can be left unseparated from each other. In this case arsenic and antimony are removed from the melt system by continuous vacuum processing of its sulphide melt. As arsenic and antimony volatilize from the sulphide melt an equilibrium is maintained between the two melts continuously corresponding to the conode equilibrium of each of them. In the Cu—As—S system illustrated in FIG. 1 the arsenide matte of composition a (conode 22) is first sulphidated to composition b, whereupon the equilibrium fraction constituted by the sulphide matte increases from 14.2% to 60.3% (conode 25). The conjugate melts corresponding to the overall composition b contain respectively 21.6 and 6.4% arsenic. If the activity coefficient of arsenic is taken to be $\gamma = 5 \times 10^{-2}$ in the region of the solubility gap and $\gamma = 3$ in the region of the homogeneous sulphide melt, then at a temperature of 1100° C. the corresponding values for the equilibrium vapour pressures are $P_{As4} = 6.7 \times 10^{-6}$ and 86 mm Hg (the vapour pressure of pure arsenic is given by log $P_{As4} = -6160T^{-1} + 9.82$, which gives $P_{As4} = 2.16 \times 10^5$ mm Hg at a temperature of 1100° C. Thus vacuum volatilization of arsenic can be easily carried out in the region of the homogeneous melt attained by sulphidation. In the region of the arsenide melt the vapour pressure of arsenic is too low for volatilization to be carried out.

In the combination of processes according to the invention the removal of impurity components from the sulphide matte is carried out by volatilization using a vacuum circulating apparatus. The vacuum refining of copper sulphide matte and crude copper has not been much practised on an industrial scale. Nevertheless the subject has been quite extensively investigated as regards the use of an absolute vacuum and also of gas vacuums. The use of a gas vacuum, i.e. rinsing the melt with an inert or slightly-reactive gas (Ar, $N_2$, $N_2+O_2$, $N_2+CO$, $N_2+SO_2$ etc), has been employed on a technical scale to some extent owing to the low capital cost of the process.

The use of gas vacuum processing is made difficult by the slowness of the method, the low partial pressure of the impurity gases, the large heat losses of the systems during the rinsing and also the fact that it is difficult to raise the sulphur potential of the melts in connection with the rinsing.

Vacuum circulating apparatus is known per se in the removal of gases from steel melts. The volatilization of impurities from sulphide melts does not require such a high vacuum as as in the aforesaid processing. The circulating gas can be partly or entirely replaced with gaseous sulphur or a mixture of sulphur and halogen, FI Pat. No. 55 357. In this case the "impfing" of the melt is confined to only one phase of the melt and to the duration of the refining. Applied to the volatilization of impurities the vacuum circulating process is very fast and its operating costs are low.

The process according to the invention thus employs a vacuum circulating or so-called mammoth pump, e.g. H. Thielmann, H. Maas: Stahl u. Eisen, 79, 1959, 276–282. The mammoth pump is particularly suitable for volatilization because the elemental sulphur gas used to increase the activities of the components being volatilized can be fed into the system together with the circulating gas, thereby achieving effective mixing of the sulphur with the melt. Using this independent vacuum apparatus sulphidation can if desired be applied principally to the molten phase in the smelting unit and only momentarily be turned to the molten phase circulating in the vacuum apparatus. Sulphidation can also be carried out only after the more easily volatilized components have been removed from the melt. The losses of elemental sulphur can be reduced to a moderate level by suitable arrangement of sulphidation, at the same time also controlling the volatilization of sulphur in the vacuum apparatus. In volatilizing components which are very difficult to remove from the sulphide melt, halogens can be added to the circulating gases of the pump, FI Pat. No. 55 357.

Figure 4:
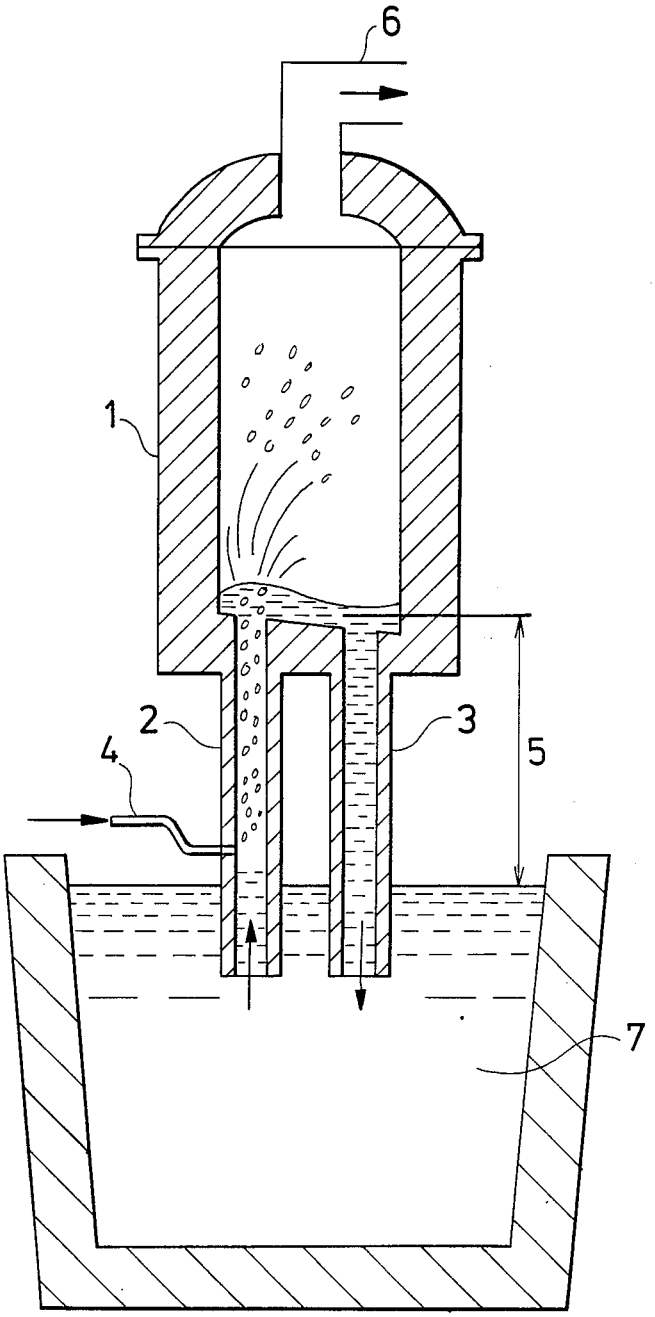

The principle of the vacuum circulating pump used in example I is represented in FIG. 4. The apparatus comprises a vacuum chamber with two pipes of equal length fixed in the bottom; one of these pipes acts as the riser pipe 2 of the vacuum circulation pump and the other as the return pipe 3. When both pipes are immersed in the sulphide melt 7 and the vacuum chamber is exhausted, the sulphide melt rises up both pipes so that the difference in height between the surfaces corresponds to the barometric height 5. Under the action of the circulating gas fed in through the inlet pipe 4 the sulphide melt circulates in the manner shown in FIG. 4. Elemental sulphur vapour or a mixture of elemental sulphur vapour and halogen is fed together with the circulating gas. In the vacuum chamber the sulphide melt is cleansed of volatile impurity components which are removed from the system together with the circulating gas through the gas pipe 6.

Figure 5:
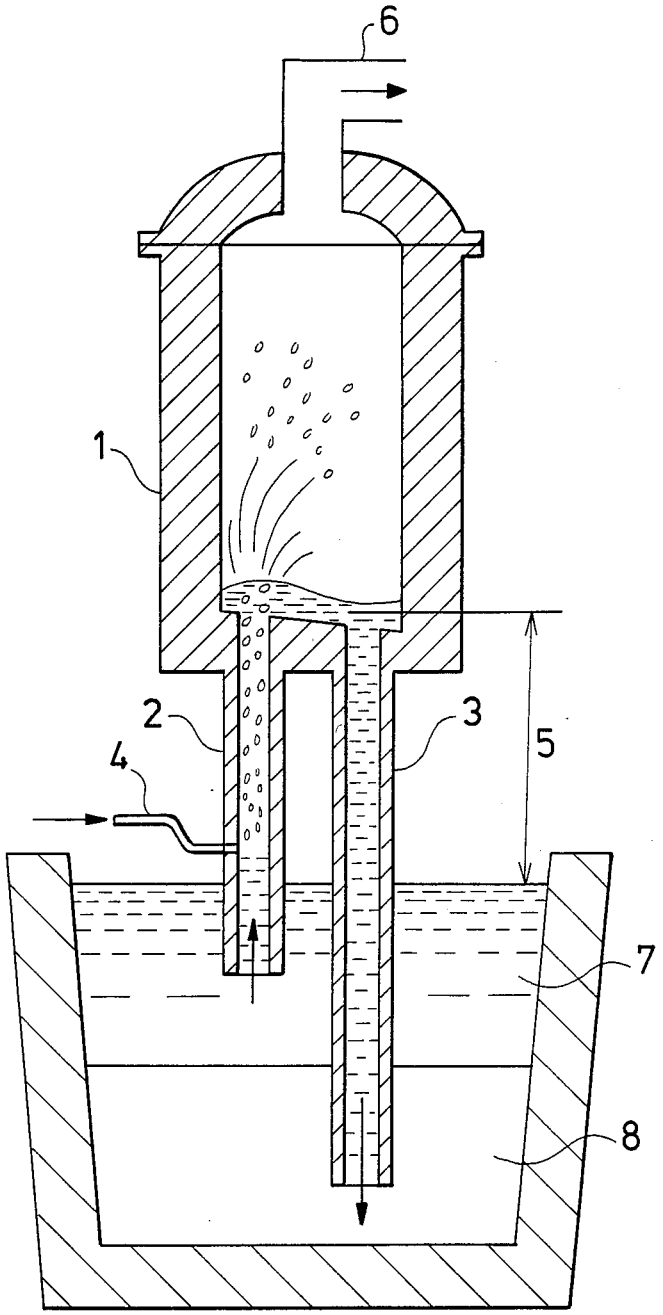

The principle of the vacuum circulating pump used in example II is shown in FIG. 5. The apparatus illustrated differs from that described in connection with example I in that the return pipe 3 is longer than the riser pipe 2 and extends below the sulphide melt 7 into the arsenide melt 8. As a result the sulphide melt which has been refined in the vacuum chamber emerges into the arsenide melt where it returns to an equilibrium state.

The process according to the invention is explained in greater detail with the aid of the following examples.

EXAMPLE I

In the case corresponding to this example a Cu—Ni—Co—Fe—Pb—Sn—As—Sb—Bi melt (table 1, no. 0) is refined in accordance with the new process.

The arsenide-antimonide matte is first sulphidated to an equilibrium state corresponding to conode 5 of FIG. 2. The materials and heat balances for the sulphidation are given in table 2. According to the materials balance 419 kg of sulphide matte are obtained from one tonne of the input matte. The following metals (% of total content in original matte) are concentrated in this sulphide phase: 59 Cu, 79 Pb and 40 Sn. Correspondingly the following metals are concentrated in the arsenide phase (659 kg): 98 Ni, 93 Co, 98.7 As and 96.2 Sb. From the heat balance sheet it can be seen that the process of sulphidating the melt is strongly exothermic.

The mattes obtained by sulphidation are separated from each other while still molten. The arsenide matte is cooled, crushed and pulverized.

In the second stage of the process structural transformation sulphidation of the finely-divided arsenide-antimonide matte is carried out in order to transform the arsenides and antimonides into stable sulphides in the solid state. The materials and heat balances for the structural transformation sulphidation are given in table 3.

The mineral structure of the solid arsenide matte was as follows: $Cu_2S$, $Cu_3As$, $Fe_2As$, $Co_5As_2$, CoSb, $Ni_5As_2$, $Ni_{11}As_8$. The matte was treated at a temperature of 1000° K. with the patial pressure of the sulphur vapour being $P_{S2}=0.75$ atm. This caused the arsenide and antimonide minerals to decompose and sulphides were formed which are stable at the temperature of the process. The mineral analysis of the product was approx. as follows: $Cu_5FeS_4$, $Cu_{1.8}S$, $Co_{0.86}S$, $Ni_{0.92}S$, PbS, $SnS_2$, $Sb_2S_3$, $Bi_2S_3$. During the sulphidation the arsenic, antimony and bismuth escape in accordance with their vapour pressures and on condensing outside the sulphidation furnace form polymers with sulphur.

The reaction temperature of the sulphidation furnace is controlled by adjusting the temperatures of the input components, i.e. of the arsenide matte and the sulphur vapour. The structural transformation sulphidation is strongly exothermic.

In the third stage of the process the vacuum refining of the sulphide matte obtained as a product in the first stage is carried out. The materials and heat balances for the refining are given in table 4. Before volatilization the input sulphide is sulphidated out of the solubility gap. The sulphur content (wt. %) of the melt then increases from 19.57 to 20.36% S (analyses (3) and (7)). In the subsequent circulating volatilization the following volatilization percentages are obtained: 99.7 Pb, 99.3 Sn, 89.3 As, 84.4 Sb, 64.7 Bi and 4.2 S.

As can be seen from the heat balance in table 4 the volatilization process is endothermic and heat must accordingly be supplied to the system during the processing.

EXAMPLE 2

In the case corresponding to this example arsenic is volatilized from the system Cu—As—S by sulphidating volatilization without separating the arsenide matte from the sulphide matte. The materials balance for the volatilization process and the combined heat balance for the sub-processes are given in table 5.

According to the materials balances in table 5, after composition b in addition to sulphidation there has been a volatilization of arsenic in the system. The composition of the mixture has thereby moved to the low-arsenic composition g of the final product by way of the intermediate compositions c, d, e(f). In practice the change in composition is continuous and can be carried out using numerous paths from a→g. The choice of the path for processing is also affected by the heat balance of the system. It can be seen from the values in the overall heat balance in table 5 that the heat quantities of the system can be adjusted not only by the temperatures of the melts but also by use of the dissociation-recombination energy of sulphur vapour. Part of the exothermic heat of the arsenide-sulphide conversion can if desired be produced in the vacuum apparatus, in which case the quantity of heat obtained can advantageously be used to replace the heat of volatilization of the impurity components.

TABLE 1

Equilibria for Cu—Ni—Co—Fe—Pb—Sn—As—Sb—Bi—S melts

| Conode equilibrium, no. | | Nernst distribution, L. Analyses of arsenide matte (A) and sulphide matte (S), wt. % | | | | | | | | | |
|---|---|---|---|---|---|---|---|---|---|---|---|
| | | Ni | Co | Cu | Fe | Pb | Sn | As | Sb | Bi | S |
| No. 0: | A | 12.40 | 3.50 | 40.10 | 2.10 | 6.8 | 4.7 | 22.2 | 5.0 | 0.20 | 1.20 |
| No. 2: | L | 45.3 | 11.8 | 0.58 | 0.59 | 0.24 | 2.32 | 43.5 | 34.5 | 6.0 | 0.04 |
| | A | 16.3 | 3.3 | 34.5 | 1.0 | 3.8 | 5.10 | 27.4 | 6.9 | 0.18 | 0.7 |
| | S | 0.36 | 0.28 | 59.4 | 1.7 | 15.8 | 2.20 | 0.63 | 0.20 | 0.03 | 16.6 |
| No. 5: | L | 33.8 | 8.64 | 0.44 | 0.50 | 0.17 | 0.94 | 46.7 | 16.3 | 3.0 | 0.09 |
| | A | 19.6 | 5.1 | 26.4 | 1.3 | 2.3 | 3.4 | 36.0 | 7.8 | 0.18 | 1.6 |
| | S | 0.58 | 0.59 | 59.6 | 2.6 | 13.3 | 3.6 | 0.72 | 0.48 | 0.06 | 18.4 |
| No. 6: | L | 22.7 | 6.67 | 0.40 | 0.40 | 0.10 | 0.10 | 38.8 | 14.2 | 2.7 | 0.65 |
| | A | 21.6 | 5.0 | 23.0 | 1.2 | 1.3 | 2.8 | 38.0 | 9.2 | 0.19 | 1.3 |
| | S | 0.95 | 0.75 | 58.2 | 3.0 | 12.9 | 4.3 | 0.98 | 0.65 | 0.07 | 18.4 |
| No. 3: | L | 3.91 | 1.87 | 0.34 | 0.34 | 0.25 | 0.25 | 6.67 | 1.54 | 0.67 | 0.55 |
| | A | 28.9 | 5.6 | 14.7 | 1.1 | 1.9 | 0.97 | 30.7 | 4.6 | 0.08 | 11.6 |
| | S | 7.4 | 3.0 | 43.6 | 3.2 | 7.5 | 3.9 | 4.6 | 3.9 | 0.12 | 21.0 |

TABLE 2

Sulphidation of Cu—Ni—Co—Fe—Pb—Sn—As—Sb—Bi melt to form arsenide-antimonide and sulphide mattes

Materials balance

Input: 1000.000 kg arsenic matte (1) + 77.470 kg sulphur vapour
Product: 658.900 kg arsenic matte (2) + 418.600 kg sulphur matte (3)

| | Analysis, wt. % | | | | | | | | | |
|---|---|---|---|---|---|---|---|---|---|---|
| Component | Cu | Fe | Co | Ni | Pb | Sn | S | As | Sb | Bi |
| As matte (1) | 40.40 | 2.10 | 3.50 | 12.40 | 6.60 | 4.70 | 1.50 | 22.20 | 5.10 | 0.20 |
| As matte (2) | 25.06 | 1.40 | 4.95 | 18.47 | 2.13 | 4.25 | 1.60 | 33.27 | 7.45 | 0.25 |
| S matte (3) | 57.06 | 2.82 | 0.58 | 0.55 | 12.42 | 4.54 | 19.57 | 0.67 | 0.46 | 0.09 |

Heat balance

| | | | | |
|---|---|---|---|---|
| **Input** | | | | |
| Arsenic matte (1) | 1000.0 kg | $\Delta H_{e+f} =$ | $76.265 \times 10^{-3} T + 10.819 \times 10^{-6} T^2$ | $- 53.523$ |
| Sulphur | 77.5 kg | | $77.5 \times H_1$ | |
| Nitrogen | 11.3 kg | | $3.053 \times 10^{-3} T$ | $- 0.988$ |
| Input, total | 1088.8 kg | $\Delta H_{e+f} =$ | $76.265 \times 10^{-3} T_1 + 10.819 \times 10^{-6} T_1^2$ | $+ 3.053 \times 10^{-3} T_2$ |
| | | | $-54.511 + 77.5 \times H_1$ | |
| **Product** | | | | |
| Arsenic matte (2) | 658.9 kg | $\Delta H_{e+f} =$ | $50.443 \times 10^{-3} T + 7.328 \times 10^{-6} T^2$ | $- 45.036$ |
| Sulphur matte (3) | 418.6 kg | | $51.747 \quad + 0.025$ | $- 57.304$ |
| Nitrogen | 11.3 kg | | $3.053$ | $- 0.988$ |
| Heat losses | | | | $+ 25.000$ |
| Product, total | 1088.8 kg | $\Delta H_{e+f} =$ | $105.243 \times 10^{-3} T_3 + 7.353 \times 10^{-6} T_3^2$ | $- 78.328$ |

Taking the input and product temperatures at $T_1 = 1473°$ K., $T_2 = 800°$ K. and $T_3 = 1536.5°$ K. the heat balance of the system is satisfied by the value $\Delta H_{e+f} = 100.736$ Mcal

TABLE 3

Structural transformation of arsenide-antimonide matte by sulphidation

Materials balance

Input: 1000.000 kg arsenic matte (2) + 760.090 kg sulphur vapour + 110.677 kg nitrogen
Product: 897.662 kg sulphur matte (4) + 862.428 kg arsenic polymer + 110.677 kg nitrogen

| | Analysis, wt. % | | | | | | | | | |
|---|---|---|---|---|---|---|---|---|---|---|
| Component | Cu | Fe | Co | Ni | Pb | Sn | S | As | Sb | Bi |
| As matte (2) | 25.06 | 1.40 | 4.95 | 18.47 | 2.13 | 4.25 | 1.60 | 33.27 | 7.45 | 0.25 |
| S matte (4) | 27.92 | 1.56 | 5.51 | 20.58 | 2.37 | 4.74 | 29.90 | 0.00 | 5.85 | 0.27 |
| Polymer | — | — | — | — | — | — | 58.87 | 38.58 | 2.55 | 0.01 |

Heat balance

| | | | | | |
|---|---|---|---|---|---|
| **Input** | | | | | |
| Arsenic matte (2) | 1000.0 kg | $\Delta H_{e+f} =$ | $75.280 \times 10^{-3} T + 12.038 \times 10^{-6} T^2$ | $- 122.994$ | |
| Sulphur | 760.1 kg | | $760.1 \times H_1$ | | |
| Nitrogen | 110.7 kg | | $29.959 \times 10^{-3} T$ | $- 9.692$ | |
| Input, total | 1870.8 kg | $\Delta H_{e+f} =$ | $75.280 \times 10^{-3} T_1 + 12.038 \times 10^{-6} T_1^2$ | $+ 29.959 \times 10^{-3} T_2$ | |
| | | | $-132.686 + 760.1 \times H_1$ | | |
| **Product** | | | | | |
| Sulphide concentrate | 897.7 kg | $\Delta H_{e+f} =$ | $90.572 \times 10^{-3} T + 18.150 \times 10^{-6} T^2$ | $- 1.561 \times 10^3 T^{-1}$ | $- 190.840$ |
| Volatilized material | 577.0 kg | | $97.989 \quad + 4.474$ | | $- 41.038$ |
| Sulphur | 285.5 kg | | $39.039$ | | $+ 124.484$ |
| Nitrogen | 110.7 kg | | $29.959$ | | $- 9.692$ |
| Heat losses | | | | | $+ 25.000$ |
| Product, total | 1870.9 kg | $\Delta H_{e+f} =$ | $257.559 \times 10^{-3} T_3 + 22.624 \times 10^{-6} T_3^2$ | $- 1.561 \times 10^3 T_3^{-1}$ | $- 92.086$ |

Taking the temperatures of the input as $T_1 = 300°$ K. and $T_2 = 889°$ K. and the temperature of the product $T_3 = 1000°$ K., the heat balance is satisfied by the total 186.536 Mcal.

$\Delta H_1 = 10^{-3} \exp_{10} [-159.568 + 184.577 \times 10^{-3} T - 69.002 \times 10^{-6} T^2 + 46727 T^{-1}]$

TABLE 4

Vacuum treatment of sulphide matte

Materials balance

Input: 1000.000 kg sulphur matte (3) + 9.827 kg sulphur vapour + 1.431 kg nitrogen
Product: 791.584 kg sulphur matte (5) + 218.243 kg volatilized sulphide/metal
+ 1.431 kg nitrogen

| | Analysis, wt. % | | | | | | | | | |
|---|---|---|---|---|---|---|---|---|---|---|
| Component | Cu | Fe | Co | Ni | Pb | Sn | S | As | Sb | Bi |
| S matte (3) | 57.06 | 2.82 | 0.58 | 0.55 | 12.42 | 4.54 | 19.57 | 0.67 | 0.46 | 0.09 |
| S matte (5) | 72.09 | 3.56 | 0.73 | 0.70 | 0.05 | 0.04 | 21.08 | 0.05 | 0.09 | 0.04 |
| Volatilized | — | — | — | — | 56.70 | 20.65 | 17.71 | 2.88 | 1.78 | 0.27 |
| S matte (7) | 56.51 | 2.79 | 0.57 | 0.55 | 12.29 | 4.50 | 20.36 | 0.66 | 0.46 | 0.09 |

Heat balance

| | | | | |
|---|---|---|---|---|
| **Input** | | | | |
| Sulphur matte (3) | 1000.0 kg | $\Delta H_{e+f} =$ | $123.619 \times 10^{-3} T + 0.061 \times 10^{-6} T^2$ | $- 136.893$ |

TABLE 4-continued

| Vacuum treatment of sulphide matte | | | | | | |
|---|---|---|---|---|---|---|
| Sulphur | 9.8 kg | | $9.827 \times H_1$ | | | |
| Nitrogen | 1.4 kg | | $0.387 \times 10^{-3}\,T$ | | $-0.125$ | |
| Energy | | | | | $+q$ | |
| Input, total | 1011.2 kg | $\Delta H_{e+f} =$ | $123.619 \times 10^{-3}\,T_1 + 0.061 \times 10^{-6}\,T_1^2$ | | $+0.387 \times 10^{-3}\,T_2$ | |
| | | | $+9.827H_1 + q - 137.018$ | | | |
| Product | | | | | | |
| Sulphur matte (5) | 791.6 kg | $\Delta H_{e+f} =$ | $107.513 \times 10^{-3}\,T + 0.032 \times 10^{-6}\,T^2$ | | $+0.013 \times 10^3\,T^{-1}$ | $-115.162$ |
| Volatilized material (6) | 218.2 kg | | 10.208 | $-0.121$ | $+0.033$ | $+31.677$ |
| Nitrogen | 1.4 kg | | 0.387 | | | $-0.125$ |
| Heat losses | | | | | | $+12.500$ |
| Product, total | 1011.2 kg | $\Delta H_{e+f} =$ | $118.108 \times 10^{-3}\,T - 0.089 \times 10^{-6}\,T^2$ | | $+0.046 \times 10^3\,T^{-1}$ | $-71.110$ |

$\Delta H_1 = 10^{-3} \exp_{10}[-159.568 + 184.577 \times 10^{-3}\,T - 69.002 \times 10^{-6}\,T^2 + 46727\,T^{-1}]$ Substituting the values $T_1 = 1536.5°$ K. and $T_2 = 800°$ K. for the temperatures of the input and the value $T_2 = 1473$ for the temperatures of the product the value $q = 47.169$ Mcal is obtained for the energy required for the volatilization process. The sum total of the balance is then 102.700 Mcal.

TABLE 5

| Sulphidating volatilization of the system Cu—As—S | |
|---|---|
| Materials balance A | 927.99 kg original mixture a (conode 22) + 72.01 kg sulphur vapour = 1000.00 kg product mixture b (conode 25) |
| Materials balance B | 1000.00 kg product mixture b + 43.12 kg sulphur vapour = 981.60 kg product mixture c (conode 11) + 61.53 kg arsenic vapour |
| Materials balance C | 981.60 kg product mixture c + 16.62 kg sulphur vapour = 975.58 kg product mixture d (conode 22) + 22.64 kg arsenic vapour |
| Materials balance D | 975.58 kg product mixture d + 5.44 kg sulphur vapour = 999.02 kg product e |
| Materials balance E | 981.02 kg product e + 17.99 kg sulphur vapour = 999.01 kg product f |
| Materials balance F | 981.02 kg product e + 17.99 kg sulphur vapour = 958.83 kg product g 40.18 kg arsenic vapour |

Materials balance

| | Analysis, wt. % | | | | | |
|---|---|---|---|---|---|---|
| | As matte | | | S matte | | |
| System | Cu | As | S | Cu | As | S |
| Mixture a | 82.51 | 13.40 | 4.09 | | | |
| Conode 22 | 83.20 | 15.00 | 1.80 | 78.30 | 3.70 | 18.00 |
| Mixture b | | | | 76.57 | 12.44 | 11.00 |
| Conode 25 | 75.60 | 21.60 | 2.80 | 77.20 | 6.40 | 16.40 |
| Mixture c | | | | 78.00 | 6.40 | 15.60 |
| Conode 11 | 78.00 | 19.60 | 2.40 | 78.00 | 4.40 | 17.60 |
| Mixture d | | | | 78.48 | 4.12 | 17.40 |
| Conode 22 | 83.20 | 15.00 | 1.80 | 78.30 | 3.70 | 18.00 |
| Mixture e | | | | 78.05 | 4.10 | 17.86 |
| Mixture f | | | | 76.64 | 4.02 | 19.34 |
| Mixture g | | | | 79.85 | — | 20.15 |

Overall heat balance 927.99 Kg mixture a + 155.19 kg sulphur vapour = 958.83 kg mixture g + 124.35 kg arsenic vapour mixture a: $\Delta H_{e+f} = 95.591 \times 10^{-3}\,T + 5.444 \times 10^{-6}\,T^2 - 58.870$ Mcal mixture g: $\Delta H_{e+f} = 128.331 \times 10^{-3}\,T - 132.868$ Mcal sulphur vapour: $\log \Delta H_{e+f}$ kcal/kg $= -159.568 + 184.577 \times 10^{-3}\,T - 69.002 \times 10^{-6}\,T^2 + 46727\,T^{-1}$ arsenic vapour: $\Delta H_{e+f}$ kcal/kg $= 59.335 \times 10^{-3}\,T + 0.120 \times 10^{-6}\,T^2 + 0.322 \times 10^3\,T^{-1} + 285.137$ Balance: With mixture a at a temperature of 1373° K., the sulphur vapour 800° K. and a product temperature of 1400° K., the balance value $\Delta H_{e+f} = 117$ Mcal is obtained, of which heat losses account for 25 Mcal. If the temperature of the sulphur vapour is raised to 1000° K. then the margin for adjustment of the process is large, approx. 50 Mcal ($\Delta H_{e+f} = 166.8$ Mcal).

What is claimed is:

1. A process for the removal of impurity components from sulphidic and metallized molten copper mattes, in which in preliminary smelting of crude metal molten sulphide and molten arsenide-antimonide phases are produced, comprising: (a) treating the molten arsenide-antimonide matte with elemental sulphur vapor to produce molten sulphide and molten arsenide phases in equilibrium with each other, then sulphurating a conjugate melt system continuously under reduced pressure in order to volatilize arsenic, antimony, bismuth, lead and tin; or (b) separating from each other the conjugate molten phases in equilibrium with each other, sulphurating a separated arsenide matte further in a solid state and advantageously using elemental sulphur vapor at high partial pressure in order to volatilize arsenic, antimony, bismuth, selenium and tellurium from the matte as sulphides, and sulphurating separated molten sulphide phase under reduced pressure to volatilize arsenic, antimony, bismuth, lead and tin from the melt; in which process the arsenide-antimonide melt, the temperature of which is 1100°-1300° C., is treated with a gas which has a temperature of 500°-600° C. and in which the partial pressure of sulphur vapor is at least 0.1 atm in order to concentrate copper, lead and tin in a sulphide phase and to concentrate nickel, arsenic and antimony in an arsenide phase.

2. A process according to claim 1, in which the solid arsenide matte, the temperature of which is 600°-800° C., is treated with a gas which has a temperature of 600°-700° C. and in which the partial pressure of sulphur vapour is at least 0.1 atm in order to volatilize arsenic, antimony and bismuth.

3. A process according to claim 1, in which the mattes obtained in the first sulphidation are separated from each other while molten and the arsenide matte is cooled, crushed and pulverized before further treatment.

4. A process according to claim 1, in which an addition of halogen is made in connection with treatment of the conjugate melt system or in treating the melts separately.

* * * * *

UNITED STATES PATENT AND TRADEMARK OFFICE

CERTIFICATE OF CORRECTION

PATENT NO. : 4,561,884

DATED : December 31, 1985

INVENTOR(S) : SIMO A.I. MAKIPIRTTI et al

It is certified that error appears in the above-identified patent and that said Letters Patent is hereby corrected as shown below:

The Title should read as follows:

--[54] PROCESS FOR REMOVAL OF IMPURITY COMPONENTS FROM SULPHIDIC AND METALLIZED MOLTEN COPPER MATTES--.

Signed and Sealed this

*Twenty-third* Day of *September 1986*

[SEAL]

*Attest:*

DONALD J. QUIGG

*Attesting Officer* *Commissioner of Patents and Trademarks*